United States Patent [19]

Rosynek et al.

[11] 4,084,722

[45] Apr. 18, 1978

[54] CHILD RESISTANT SAFETY CLOSURE

[75] Inventors: John J. Rosynek, Dolton; Anilkumar U. Patel, Summit, both of Ill.

[73] Assignee: Continental Can Company, Inc., New York, N.Y.

[21] Appl. No.: 794,882

[22] Filed: May 9, 1977

[51] Int. Cl.[2] ..... B65D 41/32

[52] U.S. Cl. ..... 220/270

[58] Field of Search ..... 220/269-273; 215/100 A

[56] References Cited

U.S. PATENT DOCUMENTS

| | | | |
|---|---|---|---|
| 3,957,172 | 5/1976 | Hasegawa | 220/269 |
| 3,986,631 | 10/1976 | Ostrem | 220/270 |

*Primary Examiner*—George T. Hall

*Attorney, Agent, or Firm*—John J. Kowalik; Joseph E. Kerwin; William A. Dittman

[57] ABSTRACT

An improved child resistant end closure wherein most of the pull tab for an easy opening end is mounted within a bead formed on the end panel which obstructs access to the ring or lift portion of the tab and pevents grasping and lifting it. The tab and/or the end panel are slightly bowed in such manner that the tab upon fastening by the rivet to the end panel is sprung toward the end panel so that the ring portion of the tab is biased toward the panel below the bead. The shape of the bead and the ring or grasping portion provides a digitally operable structure which permits an adult to insert his nail between the tab and external bead to lift the ring while flexing the end panel so that the ring may be further lifted to break free the tab hinge and then break the score defining the openable segment of the end panel, or alternatively the lift portion may be pried up by a tool entered into a slot provided beneath the ring.

18 Claims, 7 Drawing Figures

FIG. 1
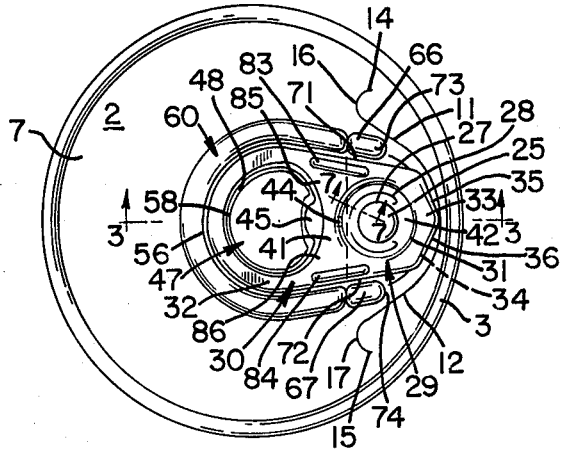
FIG. 2
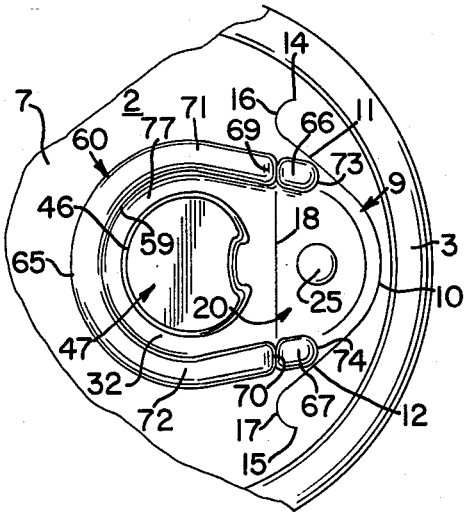
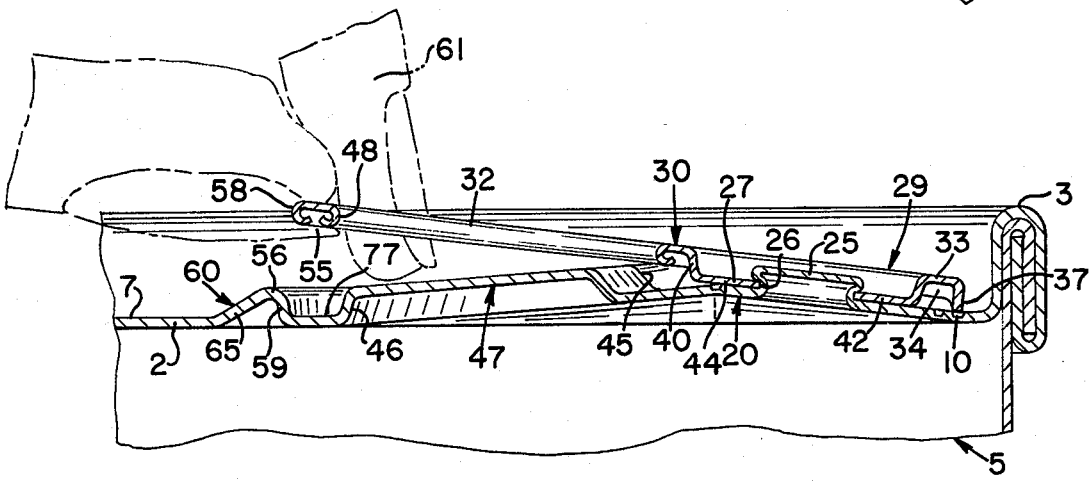
FIG. 3
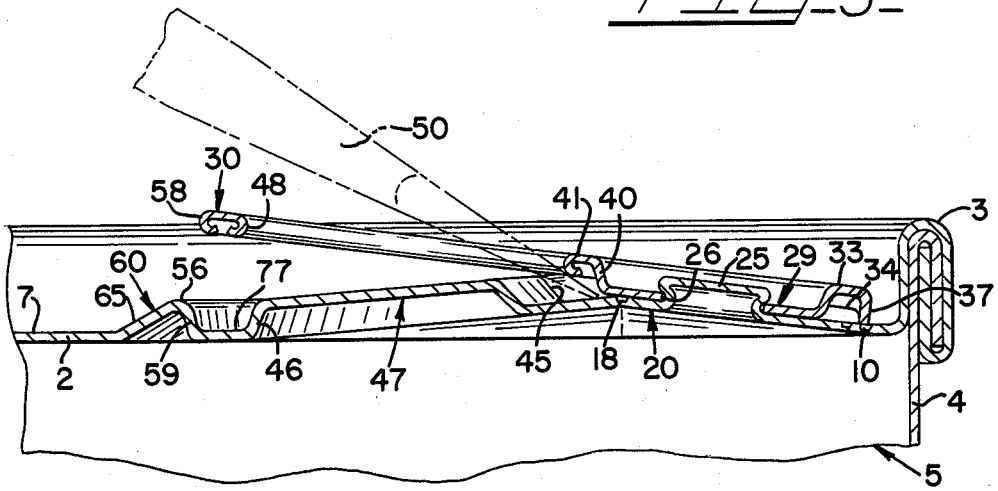
FIG. 4

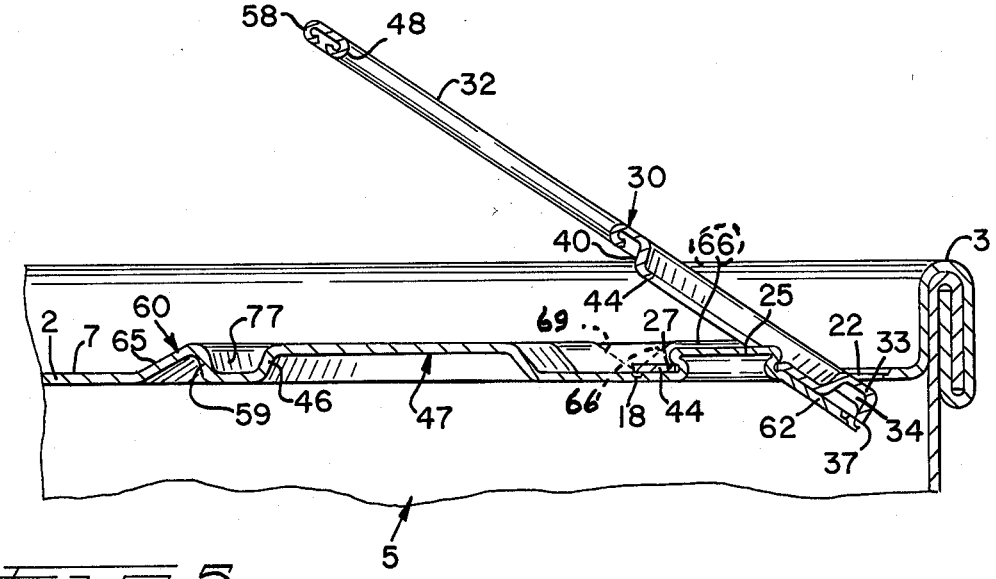
FIG. 5
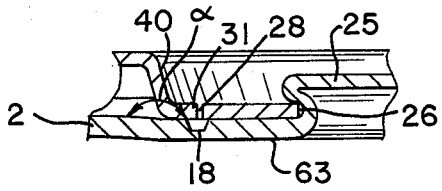
FIG. 7
FIG. 6
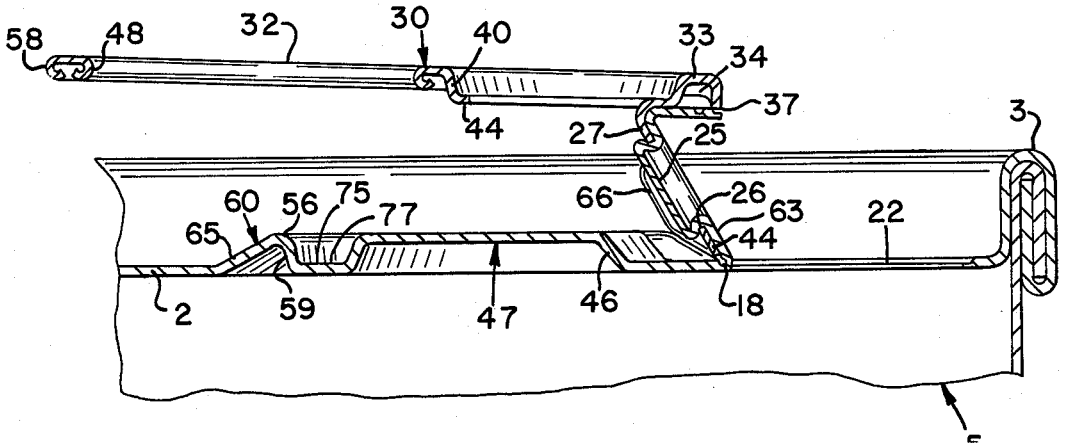

CHILD RESISTANT SAFETY CLOSURE

DISCUSSION OF THE INVENTION

The best art known are three U.S. Pat. Nos. 3,986,631, 3,967,754 and 3,958,718 owned by the assignee of the present invention. Each of these patents disclose different inventive features which, in their own way, provide a child resistant closure. In this art, however, even though legally the prior closures may qualify as being safe, it is the objective of this invention to improve the structure to make it more perfect to preclude even unanticipated accidents which would be legally excusable. Thus, the various features disclosed in the foregoing patents are improved for greater safety and functionality.

SUMMARY OF THE INVENTION

This invention is directed to a child safety closure which has a lift tab formed with a hinge connected to the tab by a fracturable strap which resists lifting until a predetermined load is applied of a magnitude beyond the capability of a child.

The primary object of the invention is to provide a novel, effective child resistant closure which is adaptable to modern manufacturing practices.

A primary object is to provide such a closure in which the tab is shielded in such a way as to prevent small fingers from prying up the tab and opening the container.

The invention comprehends providing an easy opening closure in which a tab is used to break open a scored segment of the end panel; the tab being hinged to the end panel but being prevented from hinging until a restraining strap between the hinge and tab is broken, said strap being strong enough so that it ordinarily cannot be broken by a child, but is capable of being broken by an adult.

The invention also provides extensive novel external and internal shields about and within the ring portion of the tab, the external shield extending from the nose of the tab alongside the intermediate attachment portion of the tab and about the external edge of the ring portion and being so contoured in cross-section as to allow an older person to pry the ring out of its confinement within the shield portions by inserting his finger nail between the external shield and the ring and leveraging it upwardly.

A further object is to provide a closure in which parts may be initially positioned by a tool preparatory to opening being completed by hand by pulling on the tab.

These and other objects and advantages inherent in and encompassed by the invention will become readily apparent from the following specification and drawings, wherein:

FIG. 1 is a top plan view of an end member incorporating the invention;

FIG. 2 is an enlarged top plan view of a portion of FIG. 1 with the tab removed;

FIG. 3 is an enlarged fragmentary cross-sectional view taken substantially on line 3—3 of FIG. 1 illustrating digital operation of the device;

FIG. 4 is similar to FIG. 3 showing opening the device with a tool;

FIG. 5 is a section similar to FIGS. 3 and 4 showing the tab raised to a position breaking the score and hinge attachment strap;

FIG. 6 is a sectional view similar to FIGS. 3–5 showing the device in fully open position; and FIG. 7 is an enlarged sectional view on line 7—7 of FIG. 1.

DESCRIPTION OF THE INVENTION

The invention is shown in association with a metal end panel 2, preferably steel or aluminum, which is seamed about its periphery 3 to the body 4 of a can 5.

The end panel is formed on its external side 7 adjacent to its periphery with a U-shaped score line 9 which has its bight or arcuate portion 10 adjacent to the periphery of the end member 2 and a pair of laterally spaced legs 11,12 which diverge toward the center of the panel and terminate in outwardly curved end portions 14,15, the crests 16 and 17 of which are tangent to a hinge score 18 which is formed in the top side 7 of the panel and extends cross-wise of the legs 11 and 12 of the score and permits the tear open segment or section 20 defined by the score to hinge upwardly as seen in FIG. 6 to provide a pour opening 22 in the end panel.

The tear open section 20 is provided with an integral rivet 25 which extends through aperture 26 in a hinge lug 27 defined by a C-shaped cut 28 provided through a wall 31 of an intermediate securement section 29 of a sheet metal tab 30 also preferably formed of steel or aluminum.

The tab in addition to its intermediate portion has a lift or ring end portion 32 and a nose portion 35. The nose portion has a curl 34 about its periphery and has forward edges 35,36 which converge into an apex having a downwardly extending nib 37 which is aligned vertically over the bight portion of the score for pressing thereinto attendant to lifting of the tab. The intermediate portion also has a reinforcing curl along its side edges and the ring portion is formed C-shaped in cross-section as seen in FIG. 5.

The securement section 29 of the intermediate portion of the tab is of dished shape and has an annular frusto-conical wall section 40 which at its lower edge is integral with wall 31 at at its upper edge merges with the top wall 41 of the tab.

As best seen in FIGS. 1, 5 and 6, the hinge lug 27 is connected at its end remote from its hinge connection at 42 with the nose portion, by a fracturable strap 44 to the wall 40 adjacent to the ring or lift portion of the tab and is positioned on the longitudinal center line of the tab as indicated by line 3—3 of FIG. 1 in alignment with the piercing nib 37 of the nose and directly forwardly of a notch or depression 45 formed in the frusto-conical side wall 46 of a button or internal shield 47 which extends into a finger hole 48 of the ring portion of the tab. The placement of this cavity 45 is strategic in that with the tab laying flat against the external side of the panel, the user is accommodated insertion of a tool 50 (FIG. 4) such as the end of a screw driver to lift the handle or lift end of the tab upwardly as seen in FIG. 4 so that the ring or lift portion is then accessible for grasping and lifting to open the container.

Alternatively, the invention embodies digitally operable means for lifting the tab as seen in FIG. 3. In such instance, the user inserts his thumb nail 55 over an arcuate apex or fulcrum crest 56 into a crack 57 between an external edge 58 of the ring and a closely confining upright wall 59 of an outer shield or rib generally designated 60. The user then using his nail as a lever cants it over the fulcrum 56 and then lifts the tab upwardly clearing the upper edge of the outer shield and works his forefinger 61 (FIG. 3) into the ring opening 48 and progresses under the ring portion whereupon the user may pull the ring upwardly to break the connecting strap 44, which is made to break at 6 to 8 pounds of pull beyond the normal capability of a child. Further lifting of the ring portion causes the tab to hinge about the hinge connection 42 of the hinge lug 27 and to bend the forward part 62 of the separable or openable panel segment inwardly as seen in FIG. 5. The user then pulls upwardly on the ring toward himself and continues to tear a rear part 63 of the tear portion or segment 20 until the tearing reaches the rear ends of the legs 11 and 12 of the score whereupon the rear portion of the tear section 20 hinges upwardly along hinge line 18 until it is cleared from the pour opening and assumes a rearwardly upwardly inclined position shown in FIG. 6 and is disposed at an acute included angle to the remaining panel portion.

It will be observed that the curved ends 14 and 15 of the score 9 inhibit tearing of the end panel beyond the rear ends of the legs 11 and 12.

It will be observed that the rear portion 60 of the shield or bead is horse-shoe or U-shaped and that it is formed with an external wall 65 which slopes away from the crest 56 at an acute angle to the remaining end panel portion and merges therewith.

A feature of the invention is in providing extensions 66,67 at the terminal forward ends 69,70 of the legs 71,72 of the rear portion of the external shield, bead or rib 60. The terminal ends 69,70 are disposed rearwardly of the hinge axis 18 and slope thereto and the forward extensions 66,67 are preferably formed on the rear portion 63 of the openable segment 20 along the lateral edges thereof between the legs 11,12 of the score line 9 and the lateral edges 71,72 of the intermediate portion of the tab in close confinement thereto to prevent the possibility of a child inserting anything beneath the tab and thus lifting it. The forward ends 73,74 of these extension ribs terminate in transverse alignment with the rear portion of the attachment rivet 25.

Another important feature of the invention is in having the end panel bowed slightly downwardly at an angle designated $\alpha$ between the rivet and the bottom wall 75 of the ring shield which with the inner and outer portions of the rear shield defines a groove 77 which admits the ring portion therein. This causes the lifting or ring portion to be biased into the groove 77 and yieldably maintained therein so that if a child should somehow manage to lift the ring upwardly to the positions shown in FIGS. 3 or 4, it will be difficult to hold because it will snap back into the groove. In addition, before the child could open the scored portion, he would have to exert 6–8 pounds of upward pull to break the strap. Thus, a novel and safe arrangement has been provided.

In addition, the top wall 80 of the button is substantially coplanar with the top side 81 of the ring portion so that it is virtually impossible to insert anything between the side wall of the button and inner edge of the ring.

A still further feature is in forming the protective or shield bead extensions on the rear portion 63 of the openable segment for rigidifying the rear portion and preventing it from buckling when being lifted so that it bends into a shape of the numeral seven when lifted as best seen in FIG. 6.

Raised rigidifying ribs 83,84 are also provided on the tab along its side edges in the triangular areas 85,86 in the transition connection between the intermediate section and the forward segment of the ring portion to prevent bending when the tab is lifted.

It will be readily understood from the foregoing description, that an effective child resistant closure device has been provided and that various modifications will now become apparent which fall within the scope of the appended claims.

What is claimed is:

1. a child resistant safety closure for a can or similar container having an end panel with a score therein defining a tear flap adapted to be torn from the end panel to form a pour opening;

a tab having an attachment portion, a lifting portion and a nose portion for pressing on the tear flap and fracturing the score;

said attachment portion comprising a lug cut therethrough and having one end connected to the tab providing a hinge therefor, accommodating tilting of the tab by said lift portion to force said nose portion panelwardly to fracture said score;

said cut being interrupted to provide a fracturable tie-strap between the lug and the lift portion of the tab, for resisting lifting of the tab, means for attaching the lug to the panel;

shield means on the end panel obstructing grasping of the tab; and means between the end panel and the tab adapted for prying the lift portion of the tab upwardly from said end panel and attendant fracturing of the tie-strap to disassociate the lift portion from said shield means in accessible position for further lifting and tearing of said tear portion at said score.

2. A child resistant closure for an end panel of a container comprising a score on the panel defining a segment openable to form a pour opening, a tab disposable flatwise against the external side of said panel and having a lift portion and an intermediate securement portion providing a transverse hinge line about which said tab is adapted to be tilted, and a nose portion at one side of the hinge line operable to break the score upon the nose portion being pressed against said openable segment attendant to lifting of said lift portion, means for securing said securement portion to the end panel, strap means connecting said securement portion to said tab in an area remote from said hinge line, said strap means being fracturable upon the imposition against said lifting portion of a lifting load of a magnitude beyond the ordinary capability of a young child, and anti-prying means on said end panel cooperatively disposed about said tab for preventing prying up of said lift portion by a child, said anti-prying means including digitally operable means for accommodating entry of a finger nail or the like beneath the lift portion to effect lifting of the lift portion into a position of disassociation with said anti-prying means to accommodate the lift portion to be digitally grasped and lifted.

3. The invention according to claim 2 and means for providing a hinge axis on said end panel for said openable segment about which said segment is adapted to hinge to a position away from said opening.

4. The invention according to claim 3 and said hinge axis extending transversely of the tab.

5. The invention according to claim 2 and means for biasing said lift portion against said panel and having an operating range capable of returning said tab to its position flatwise against said panel from a position whereat said lift portion is raised out of association of said anti-prying means preparatory to breaking said strap or fracturing said score.

6. The invention according to claim 4 and said anti-prying means comprising a bead extending about said tab in close proximity to the outer edge thereof and having a first portion enclosing said lift portion and terminating at said hinge line and having a second portion flanking said securement portion and extending from said hinge line alongside opposite edges of said securement portion toward said nose portion.

7. The invention according to claim 6 and said score defining said pour opening being generally U-shaped with outturned ends disposed adjacent to the opposite end of said hinge axis, said axis being defined by a score line bridging the open end of the U.

8. The invention according to claim 7 and said anti-prying means comprising a button formed on the end panel extending through a complemental finger opening in the lift portion of the tab and a tool-admitting notch formed in the edge of said button located adjacent to a portion of the tab opposite to which said fracturable strap is attached to permit prying up said last mentioned portion to fracture the strap and lift said lift portion to a grasp position.

9. The invention according to claim 8 wherein said tab is formed of sheet metal and said hinge portion is formed from said attachment portion of the tab by a C-shaped cut having its legs terminating at said nose portion and its bight positioned adjacent to said lift portion.

10. The invention according to claim 2 and said anti-prying means comprising a first bead portion formed on the end panel in close confinement to said lift portion and other separate bead portions flanking at least said securement portion of the tab.

11. The invention according to claim 10 and each said bead portion having a wall portion sloping upwardly from the plane of the end panel and terminating in a rounded apex located slightly above the tab in its flatwise position on the end panel and each said bead further having an essentially vertical wall extending from the apex in close proximity to the adjacent edge of the tab, said vertical wall terminating in a lower edge merging with said end panel.

12. The invention according to claim 10 and means providing a hinge axis for said openable segment and said axis passing between said first bead portion and said other separate bead portions.

13. The invention according to claim 12 and said other separate bead portions being located on the openable segment along opposite edges thereof.

14. A child resistant closure for an end member of a container comprising a score defining a tear out section to form a pour opening, means for tearing out said section comprising a substantially flat tab having a lift portion, an attachment portion and a nose portion, means on said attachment portion providing a hinge for the tab, fracturable means attaching said hinge to said tab inhibiting lifting of the tab to a predetermined lifting force effective to sever said fracturable means to permit hinging movement of the tab and lifting of said lift portion and reaction of the nose portion against said section for fracturing the score thereby causing separation of said section from the end member, and means shielding said tab to an extent preventing persons of limited dexterity and strength from obtaining a purchase on the lift portion to lift the same and swing the tab upright to open said container.

15. The invention according to claim 14 and said lift portion comprising a ring, and said shielding means comprising a bead on the panel number closely circumscribing the exterior marginal edge of the ring and a button formed on the panel member closely fitting within the ring.

16. The invention according to claim 15 and said bead having a transverse profile including an outer wall sloping from the plane of the end member upwardly and terminating in a rounded crest at an elevation generally above the top side of the ring and a generally vertical inner wall extending from the crest to said end member and closely confining said ring and at least the major part of said attachment portion of the tab, and shield means on the end panel extending into said ring in close proximity thereto.

17. The invention according to claim 16 and means on at least one of said tab and end panel biasing said tab against said panel for resisting lifting of said lift portion.

18. The invention according to claim 17 and said biasing means comprising a downwardly bowed segment of said panel member in the area between the attachment of the tab to said end panel and said lift portion.

* * * * *